US007731348B2

(12) United States Patent
Mitsuhashi et al.

(10) Patent No.: US 7,731,348 B2
(45) Date of Patent: Jun. 8, 2010

(54) INKJET RECORDING APPARATUS

(75) Inventors: Taku Mitsuhashi, Hachioji (JP); Keiichiro Suzuki, Hachioji (JP); Takayuki Kato, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 1065 days.

(21) Appl. No.: 11/408,263

(22) Filed: Apr. 20, 2006

(65) Prior Publication Data

US 2006/0238596 A1 Oct. 26, 2006

(30) Foreign Application Priority Data

Apr. 25, 2005 (JP) ..... 2005-126252

(51) Int. Cl.
*B41J 2/01* (2006.01)

(52) U.S. Cl. ..... 347/104; 271/193; 347/22; 347/23; 347/32; 347/102; 347/103; 358/440

(58) Field of Classification Search ..... None
See application file for complete search history.

(56) References Cited

U.S. PATENT DOCUMENTS 6,916,081 B2 * 7/2005 Nakashima ..... 347/32
6,979,071 B2 * 12/2005 Suzuki et al. ..... 347/22
2005/0168515 A1 * 8/2005 Nagai et al. ..... 347/23

FOREIGN PATENT DOCUMENTS

JP 2003-205658 A 7/2003

* cited by examiner

*Primary Examiner*—Matthew Luu
*Assistant Examiner*—John P Zimmermann
(74) *Attorney, Agent, or Firm*—Frishauf, Holtz, Goodman & Chick, P.C.

(57) ABSTRACT

An inkjet recording apparatus comprising: a conveyance belt for conveying a recording medium; a cleaning roller kept in contact with the conveyance belt to clean the conveyance belt; and a controller for controlling the cleaning roller so as to be able to select between two modes for its driving, wherein the two modes are the mode in which the cleaning roller is driven by the movement of the conveyance belt and the mode in which the cleaning roller is driven independently of the movement of the conveyance belt.

11 Claims, 13 Drawing Sheets

FIG. 5

30

| TYPE OF RECORDING MEDIUM | AMOUNT OF PENETRATED INK T0 ($mg/m^2$) |
|---|---|
| PLAIN PAPER | 10 |
| HIGH-GRADE PAPER | 16 |
| RESIN FILM | 12 |
| | |

INKJET RECORDING APPARATUS

FIELD OF THE INVENTION

The present invention relates to an inkjet recording apparatus for conveying a recording medium by a belt.

BACKGROUND OF THE INVENTION

The inkjet type recording apparatus has come into widespread use for various types of recording mediums as an apparatus for recording a high definition image. In this inkjet recording apparatus, when the recording medium is a flexible fabric, the recording medium is fed to the position below the recording head in an endless manner by a conveyance belt, and ink is emitted from the recording head to the recording medium.

In this case, the ink emitted from the recording head may reach the area protruding from the edge of a recording medium and may stick to the conveyance belt by penetrating the recording medium (printing through) or going through so-called "printing without border". In this case, the ink is transferred to the recording medium having been supplied newly and the recording medium is contaminated. Normally, a mechanism for cleaning the conveyance belt is installed on the inkjet recording apparatus equipped with such a conveyance mechanism (for example Official Gazette of Japanese Patent Tokkai 2003-205658).

To put it more specifically, in the cleaning mechanism described in the Official Gazette of Japanese Patent Tokkai 2003-205658, the guide roller (14) of a conveyance belt (4) is placed opposite to the cleaning roller (cleaning sponge 17*b*) having been absorbed a cleaning liquid (water), as shown in FIG. 10. A conveyance belt passes through these rollers. During the course of passage, cleaning roller is rotated by following the conveyance belt, and absorbs and removes ink attached to the conveyance belt (paragraph numbers 0016 and 0025).

However, in the cleaning mechanism of the Patent Document 1, the cleaning roller is driven by the conveyance belt. This ensures the cleaning roller to be impervious to damage and provides excellent roller durability, but an increase in the amount of ink deposited on the conveyance belt or an increased in the conveyance speed of the recording medium (conveyance belt traveling speed) is considered to cause a considerable reduction in the efficiency of removing the ink deposited on the conveyance belt, as shown in FIGS. 11 and 12.

If the cleaning roller is designed to be driven by itself without being driven by the conveyance belt, a high ink removal rate can be maintained, as shown in FIG. 13. However, the cleaning roller rubs against the conveyance belt, and this reduces roller durability. The object of the present invention is to improve roller durability while maintaining a high efficiency of removing the ink deposited on the conveyance belt.

SUMMARY OF THE INVENTION

It is therefore an object of the present invention to provide an improved inkjet recording apparatus. The inkjet recording apparatus including: a conveyance belt for conveying a recording medium; a cleaning roller kept in contact with the conveyance belt to clean the conveyance belt; and a controller for controlling the cleaning roller so as to be able to select between two modes for its driving, wherein the two modes are the mode in which the cleaning roller is driven by the movement of the conveyance belt and the mode in which the cleaning roller is driven independently of the movement of the conveyance belt.

BRIEF DESCRIPTION OF THE DRAWINGS

FIG. 5 is a diagram representing an example of the data table 30;

DESCRIPTION OF THE PREFERRED EMBODIMENT

Figure 1:
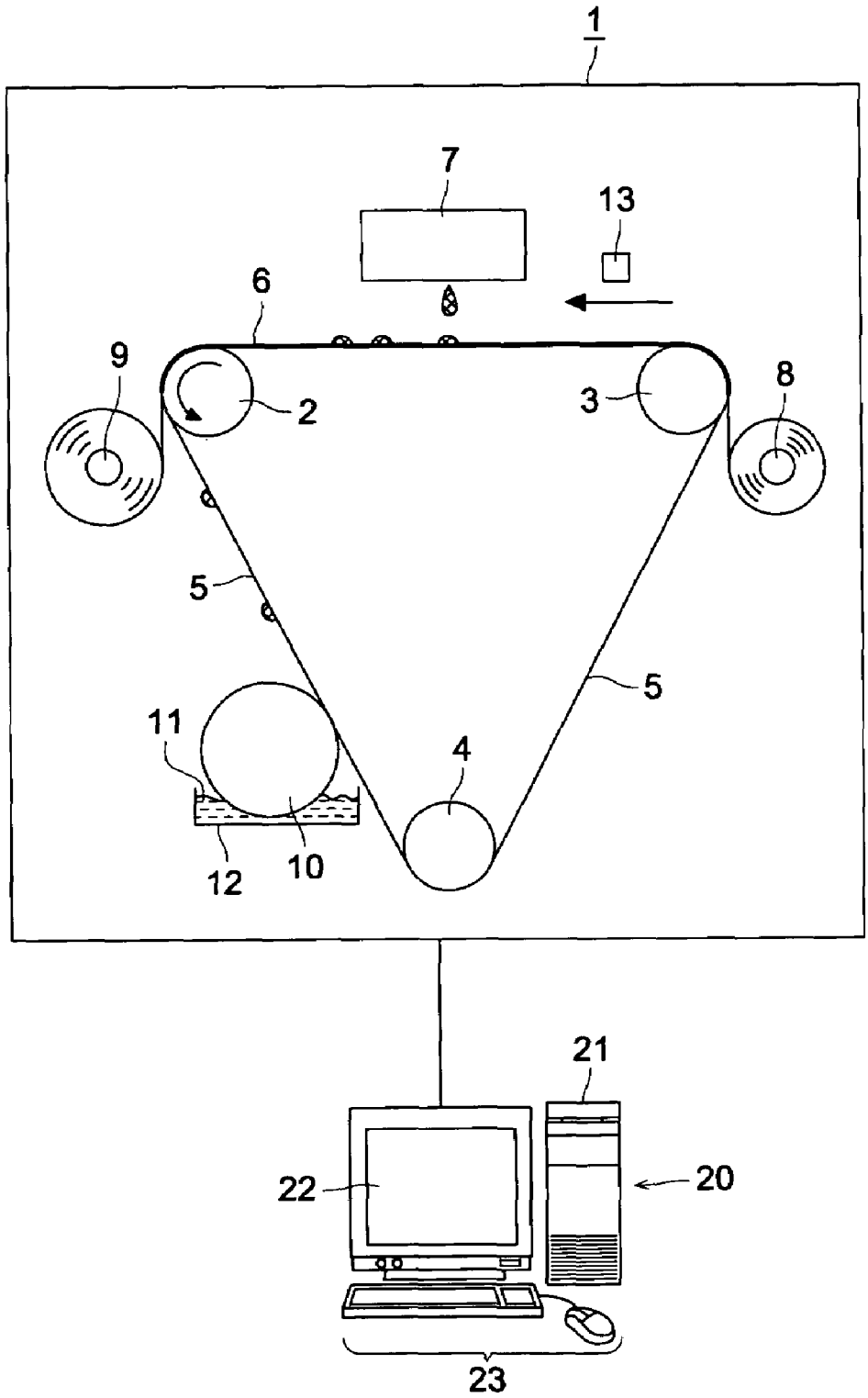
FIG. 1 is a side view showing the schematic arrangement of the inkjet recording apparatus 1.

The above objectives of this invention can be achieved by the following constitutions.

(1) An inkjet recording apparatus contains:

a conveyance belt for conveying a recording medium; and a cleaning roller kept in contact with the conveyance belt to clean the conveyance belt;

wherein selection is made between the mode in which the cleaning roller is driven by the movement of the conveyance belt, and the mode in which the cleaning roller is driven independently of the movement of the conveyance belt.

(2) The inkjet recording apparatus described in (1) is connected with a computer capable of controlling the selection between the mode in which the cleaning roller is driven by the movement of the conveyance belt and the mode in which the cleaning roller is driven independently of the movement of the conveyance belt, and the selection between two modes of cleaning roller drive method is implemented by the instruction from the computer.

(3) The inkjet recording apparatus described in (2) further containing a speed detector for detecting the traveling speed V0 of the conveyance belt, wherein, when the computer has determined based on the result of detection by the speed detector that the traveling speed V0 of the conveyance belt is V0<6 mm/second, the cleaning roller is driven by the movement of the conveyance belt.

(4) The inkjet recording apparatus described in (2) further containing a speed detector for detecting the traveling speed V0 of the conveyance belt, wherein, when the computer has determined based on the result of detection by the speed detector that the traveling speed V0 of the conveyance belt is V0≧6 mm/second, the cleaning roller is driven independently of the movement of the conveyance belt.

(5) The inkjet recording apparatus described in (2) further containing a width detector for detecting the width W0 of the recording medium, wherein, when the computer has determined based on the result of detection by the width detector that the width W0 of the recording medium relative to recording width W1 is W0>W1, the cleaning roller is driven by the movement of the conveyance belt.

(6) The inkjet recording apparatus described in (2) further containing a width detector for detecting the width W0 of the recording medium, wherein, when the computer has determined based on the result of detection by the width detector that the width W0 of the recording medium relative to recording width W1 is W0≦W1, the cleaning roller is driven independently of the movement of the conveyance belt.

(7) The inkjet recording apparatus described in (2);

wherein the computer has a data table corresponding to the amount of penetrating ink T0 that passes through the recording medium, for each type of the recording medium;

wherein, if an image is recorded on the recording medium, the amount of penetrating ink T0 corresponding to the type of the recording medium is specified based on the data table; and wherein, if the amount of penetrating ink T0 has been determined as T0≦12 mg/m$^2$, the cleaning roller is driven by the movement of the conveyance belt.

(8) The inkjet recording apparatus described in (2);

wherein the computer has a data table corresponding to the amount of penetrating ink T0 that passes through the recording medium, for each type of the recording medium;

wherein, if an image is recorded on the recording medium, the amount of penetrating ink T0 corresponding to the type of the recording medium is specified based on the data table; and wherein, if the amount of penetrating ink T0 has been determined as T0>12 mg/m$^2$, the cleaning roller is driven independently of the movement of the conveyance belt.

(9) The inkjet recording apparatus described in (2);

wherein the computer acquires the resolution and record size from the image data of the image to be recorded on the recording medium and calculates the amount of ink Q0 required to record an image on the recording medium; and wherein, if the amount of ink Q0 has been determined as Q0≦12 g/m$^2$, the cleaning roller is driven by the movement of the conveyance belt.

(10) The inkjet recording apparatus described in (2);

wherein the computer acquires the resolution and record size from the image data of the image to be recorded on the recording medium and calculates the amount of ink Q0 required to record an image on the recording medium; and wherein, if the amount of ink Q0 has been determined as Q0>12 g/m$^2$, the cleaning roller is driven independently of the movement of the conveyance belt.

(11) The inkjet recording apparatus described in (2);

wherein the computer calculates the amount of deposited ink H0 deposited on the conveyance belt, from the image data of the image to be recorded on the recording medium, and, if the amount of deposited ink H0 has been determined as H0≦30%, the cleaning roller is driven by the movement of the conveyance belt.

(12) The inkjet recording apparatus described in (2);

wherein the computer calculates the amount of deposited ink H0 deposited on the conveyance belt, from the image data of the image to be recorded on the recording medium, and, if the amount of deposited ink H0 has been determined as H0>30%, the cleaning roller is driven independently of the movement of the conveyance belt.

(13) The inkjet recording apparatus described in (1) to (12), wherein the cleaning roller is an elastic member made of a porous material.

(14) The inkjet recording apparatus described in (13), wherein the specific gravity of the cleaning roller is 0.32 through 0.34 g/cm$^3$.

(15) The inkjet recording apparatus described in (13) or (14), wherein porosity of the cleaning roller is 75 through 90%.

(16) The inkjet recording apparatus described in (13) or (15), wherein the cleaning roller is impregnated with water.

(17) The inkjet recording apparatus described in (1) to (16), wherein, when the cleaning roller is being driven, the outer peripheral linear speed R0 can be changed as desired within the range from 20 through 120 mm/second.

(18) The inkjet recording apparatus described in (1) to (17), wherein the cross sectional length of contact L0 of the cleaning roller with respect to the conveyance belt is within the range from 10 through 20 mm.

(19) The inkjet recording apparatus described in (1) to (18), wherein the conveyance belt is adhesive on the contact surface with the recording medium.

(20) The inkjet recording apparatus described in (19), wherein the surface of the conveyance belt in contact with the recording medium is coated with agglutinant made up of a silicon based material, and the amount of the agglutinant applied is within the range from 50 through 60 g/m$^2$.

(21) The inkjet recording apparatus described in (1) to (20), wherein the cleaning roller is pressed against and is kept in contact with the conveyance belt, and the conveyance belt directly withstands the pressure of the cleaning roller.

The present invention described in (1) improves the roller durability while keeping a high efficiency of removing ink from the conveyance belt.

According to the present invention described in (2), based on the instruction of the computer, selection can be made between the mode in which the cleaning roller is driven by the movement of the conveyance belt and the mode in which the cleaning roller is driven independently of the movement of the conveyance belt.

According to the present invention described in (3) or (4), based on the traveling speed V0 of the conveyance belt, selection can be made between the mode in which the cleaning roller is driven by the movement of the conveyance belt and the mode in which the cleaning roller is driven independently of the movement of the conveyance belt.

According to the present invention described in (5) or (6), based on the width W0 of the recording medium, selection can be made between the mode in which the cleaning roller is driven by the movement of the conveyance belt and the mode in which the cleaning roller is driven independently of the movement of the conveyance belt.

According to the present invention described in (7) or (8), based on the amount of penetrating ink T0 passing through the recording medium, selection can be made between the mode in which the cleaning roller is driven by the movement of the conveyance belt and the mode in which the cleaning roller is driven independently of the movement of the conveyance belt.

According to the present invention described in (9) or (10), based on the amount of ink Q0 required to record an image on the recording medium, selection can be made between the mode in which the cleaning roller is driven by the movement of the conveyance belt and the mode in which the cleaning roller is driven independently of the movement of the conveyance belt.

According to the present invention described in (11) or (12), based on the amount of ink H0 deposited on the conveyance belt, selection can be made between the mode in which the cleaning roller is driven by the movement of the conveyance belt and the mode in which the cleaning roller is driven independently of the movement of the conveyance belt.

According to the present invention described in any one of (13) through (18), the cleaning roller can be kept in contact with the conveyance belt to completely remove ink deposited on the conveyance belt.

According to the present invention described in any one of (9) through (21), a slip is prevented from occurring between conveyance belt and recording medium and the recording medium is fed thoroughly without the recording medium being wrinkled.

The following describes the best form for carrying out the present invention with reference to drawings: Various technically preferable restrictions for the embodiment of the present invention are involved in the following description of the embodiment, without the present invention being restricted to the following embodiments and drawings.

FIG. 1 is a side view showing the schematic arrangement of the inkjet recording apparatus 1 of the present invention. As shown in FIG. 1, the inkjet recording apparatus 1 is provided with a drive roller 2 driven through transmission of the power source and two guide rollers 3 and 4. An endless conveyance belt 5 is wound between the drive roller 2 and each of the guide rollers 3 and 4. The drive roller 2 is connected with a motor 2*a* (FIG. 4) as the power source. When the motor 2*a* has actuated, the drive roller 2 rotates in the counterclockwise direction in FIG. 1. With the rotation thereof, the conveyance belt 5 rotates in the counterclockwise direction in FIG. 1, as it is guided by each of the guide rollers 3 and 4.

The surface of the conveyance belt 5 is coated with the adhesive made of silicon based material. The surface of the conveyance belt 5 (surface in contact with the recording medium 6) is adhesive. Accordingly, the conveyance belt 5 has an excellent adhesive strength to stick to the recording medium 6. This arrangement provides resistance to a slip with the recording medium 6, and ensures correct feed of the recording medium 6 without being wrinkled.

The weight of the agglutinant applied to the conveyance belt 5 is 50 through 60 g/m$^2$. If this weight to be applied is less than 50 g/m$^2$, the adhesive strength on the conveyance belt to stick to the recording medium will reduce, and precision in the conveyance of the recording medium will deteriorate, with the result that image quality may deteriorate. If the weight to be applied is over 60 g/m$^2$, the adhesive strength will increase and the precision in the conveyance of the recording medium will improve, at the sacrifice of increased costs.

The surface of the conveyance belt 5 can be coated with agglutinant made of acryl based material, instead of the silicon based agglutinant or with a self-adhesive tape formed of silicon based material or acryl based material.

A recording head 7 for emitting ink to the conveyance belt 5 is arranged over the conveyance belt 5 between the drive roller 2 and guide roller 3. The recording head 7 is designed as a serial type recording head which emits ink by traveling through the front and rear of the paper shown in FIG. 1.

A master roller 8 wound with a long recording medium 6 is arranged off to the lower right of guide roller 3. A take-up roller 9 for taking up the recording medium 6 from the master roller 8 is arranged off to the lower left of the drive roller 2. The take-up roller 9 is designed to rotate in the clockwise direction in FIG. 1. When this take-up roller 9 rotates, the recording medium 6 is fed from the master roller 8. Supported by the conveyance belt 5, the recording medium 6 passes between the conveyance belt 5 and recording head 7, and is wound by the take-up roller 9 in the final phase.

The cleaning roller 10 for removing the ink deposited on the conveyance belt 5 and cleaning the conveyance belt 5, and a liquid tank 12 storing the cleaning liquid 11 are arranged between the drive roller 2 and driven roller 4. The cleaning roller 10 is an elastic member made of porous material. It is kept immersed in the cleaning liquid 11 of the liquid tank 12. Water is used as a cleaning liquid 11.

The cleaning roller 10 has a specific gravity of 0.32 through 0.34 g/cm$^3$ and a porosity of 75 through 90%. If the specific gravity of the cleaning roller 10 is less than 0.32 g/cm$^3$, the water absorption properties are improved but the water retentivity is also increased. Before it contacts the conveyance belt, the cleaning roller will contain much water. This may cause water to remain when ink is removed. If the specific gravity of the cleaning roller 10 is over 0.34 g/cm$^3$, water absorption properties will deteriorate and the efficiency of removing ink from the conveyance belt may reduce. If the porosity of the cleaning roller 10 is less than 75%, water absorption properties will deteriorate and the efficiency of removing ink from the conveyance belt may reduce. If the porosity of the cleaning roller 10 is over 90%, water absorption properties will improve, but water retentivity is also increased. Before it contacts the conveyance belt, the cleaning roller will contain much water. This may cause water to remain when ink is removed.

Figure 2:
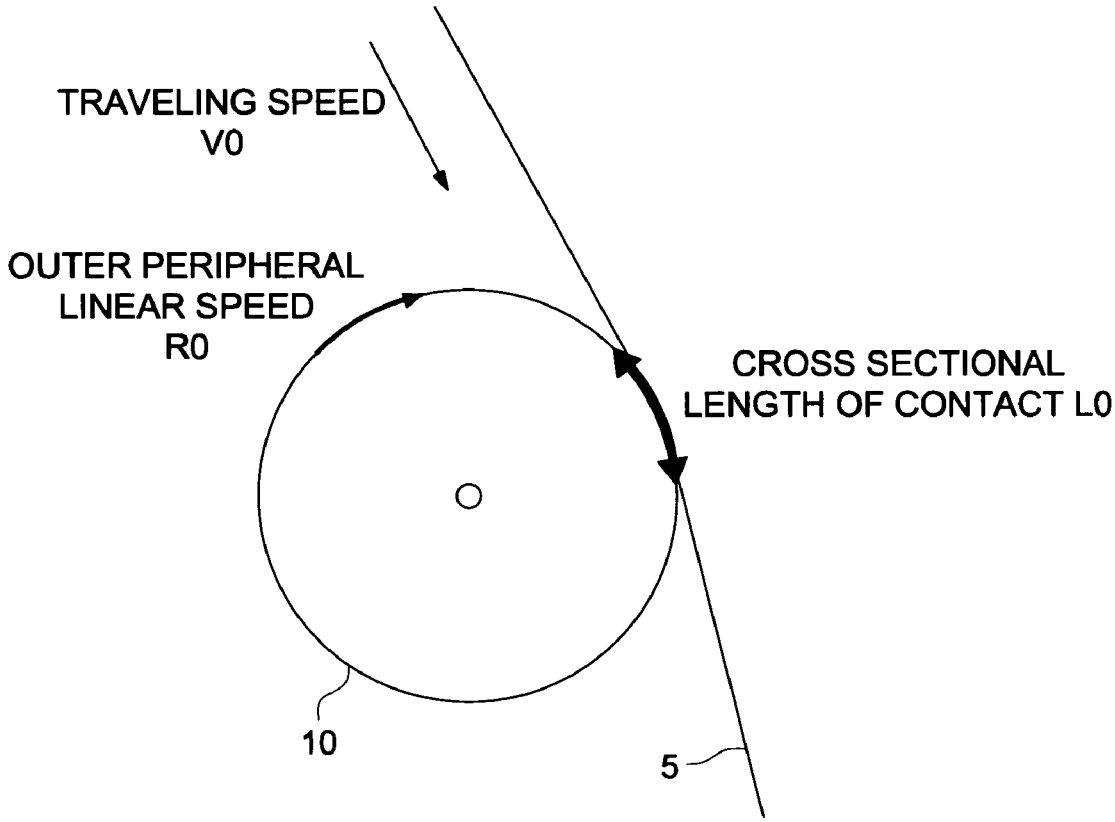
FIG. 2 is an enlarged view representing the arrangement closed to the position of contact between the cleaning roller 10 and conveyance belt 5.

FIG. 2 is an enlarged view closed to the position of contact between the cleaning roller 10 and conveyance belt 5. As shown in FIG. 2, the cleaning roller 10 is pressed against and is kept in contact with the surface of the conveyance belt, and the conveyance belt 5 alone directly withstands the pressure of the cleaning roller 10. This arrangement ensures that the cleaning roller 10 in close contact with the conveyance belt 5 thoroughly removes the ink from the conveyance belt 5.

Figure 3:
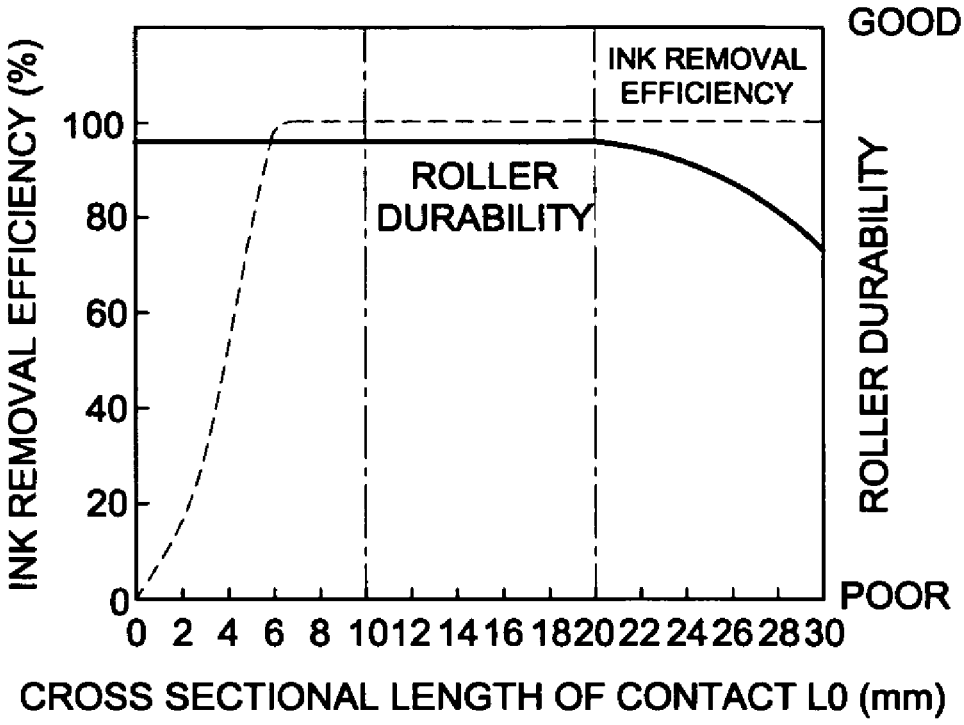
FIG. 3 is a diagram showing an example of the relationship between the "ink removal efficiency" and "cleaning roller durability" in conformity to the cross sectional length of contact L0.

To put it more specifically, the cleaning roller 10 is mounted in such a position that the cross sectional length of pressure L0 is kept within the range from 10 through 20 mm at the position of contact with the conveyance belt 5. "The cross sectional length of pressure L0" can be defined as the distance on the outer periphery of the cleaning roller 10 at the position of contact between the cleaning roller 10 and conveyance belt 5. The cross sectional length of pressure L0 is set within the range from 10 through 20 mm. This is because the roller durability of the cleaning roller 10 can be improved within this set range, while a high efficiency of removing ink from the conveyance belt 5 is maintained, as shown in FIG. 3.

Figure 4:
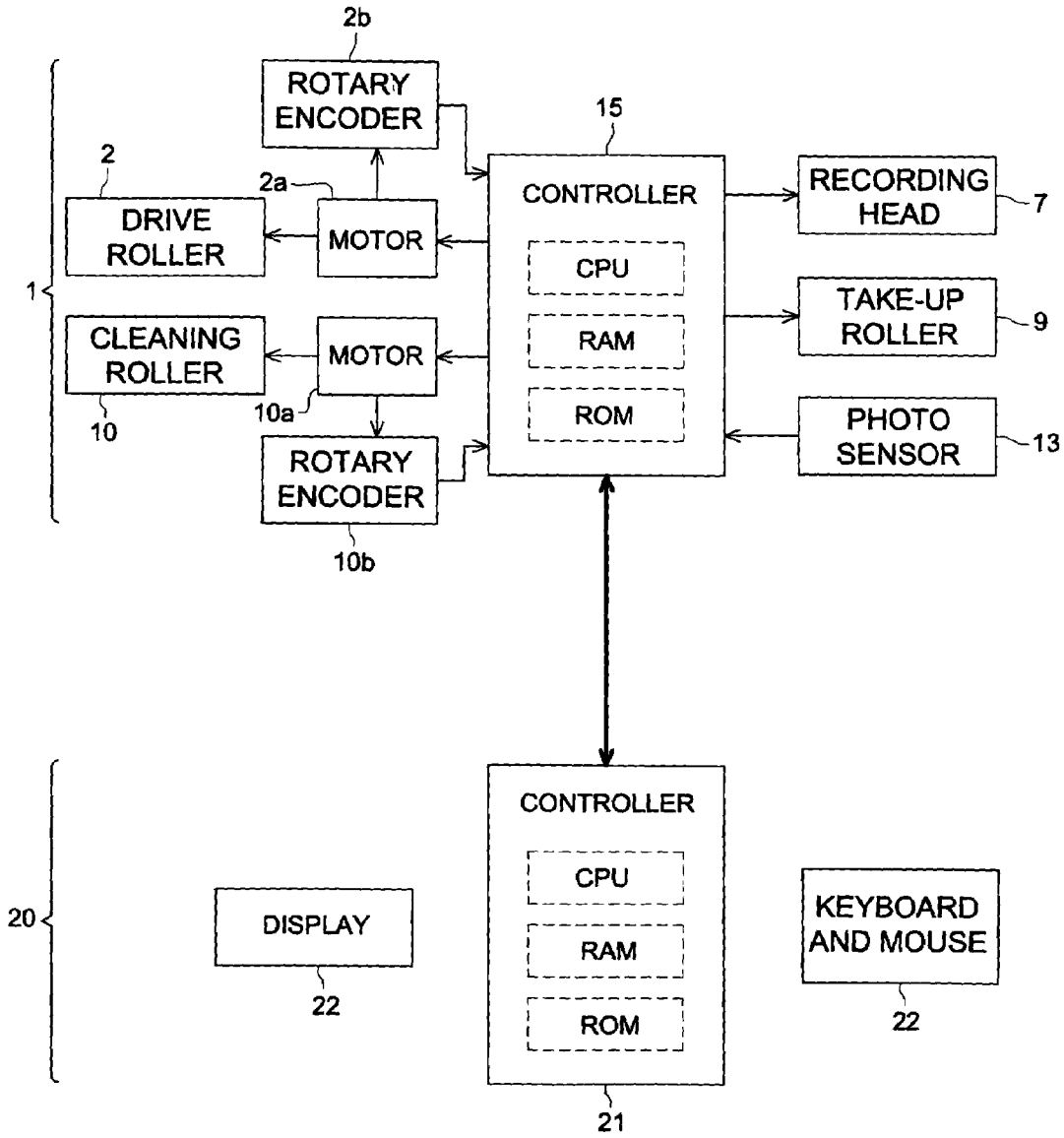
FIG. 4 is a block diagram representing the control circuit of the inkjet recording apparatus 1.

The cleaning roller 10 is connected with motor 10*a* as a power transmission means such as a belt (FIG. 4). The cleaning roller 10 is driven by the rotation of the conveyance belt 5. It is designed to be driven by the power of the motor 10*a*, not by the rotation of the conveyance belt 5. When the cleaning roller 10 is driven by the power of the motor 10*a*, the cleaning roller 10 is driven in the same direction as that of the movement of the conveyance belt 5 at the position of contact with the conveyance belt 5.

As shown in FIG. 1, a photo-sensor 13 as a width detector for detecting the width W0 of the recording medium 6 is provided downstream of the guide roller 3 in the direction of the movement of the conveyance belt 5 and upstream of the recording head 7.

The following describes the control arrangement of the inkjet recording apparatus 1 (including the relationship with computer 2):

FIG. 4 is a block diagram representing the control circuit of the inkjet recording apparatus 1.

As shown in FIG. 4, the inkjet recording apparatus 1 incorporates a controller 15 for controlling the operation of each member. The controller 15 is connected with a drive roller 2 (motor 2*a*), recording head 7, take-up roller 9, and cleaning roller 10 (motor 10*a*). The controller 15 includes a general-purpose CPU (Central Processing Unit), ROM (Read Only Memory) and RAM (Random Access Memory). The controller 15 provides control in such a way that the CPU displays the processing program recorded in the ROM, on the RAM, and this processing program is implemented. It also controls the operation of such members as the drive roller 2.

The motor 2*a* of the drive roller 2 is provided with a rotary encoder 2*b*. The rotary encoder 2*b* is connected with the controller 15. In response to the result of detection of the rotary encoder 2*b* as the speed detector, the controller 15 calculates the traveling speed V0 of the conveyance belt 5 (FIG. 2).

In the manner similar to the above, the motor 10*a* of the cleaning roller 10 is also connected with the rotary encoder 10*b*. The rotary encoder 10*b* is connected with the controller 15. In response to the result of detection of the rotary encoder 10*b*, the controller 15 calculates the outer peripheral linear speed R0 of the cleaning roller 10 (FIG. 2). The "outer peripheral linear speed R0" of the cleaning roller 10 refers to the speed at which a point on the outer periphery of the cleaning roller 10 travels along the outer periphery of the cleaning roller 10.

The controller 15 is connected with the photo-sensor 13. In response to the result of detection of the photo-sensor 13, the controller 15 calculates the width W0 of the recording medium 6.

In the meantime, the computer 20 has a controller 21 capable of sending and receiving the data and signal with the controller 15 of the inkjet recording apparatus 1. The controller 21 is connected with a display 22 and keyboard/mouse 23. The controller 21, similarly to the case of the controller 15, is composed of a general-purpose CPU (Central Processing Unit), ROM (Read Only Memory) and RAM (Random Access Memory).

In particular, the controller 21 (the ROM thereof) contains a data table 30 as shown in FIG. 5. In the data table 30, the type of the recording medium 6 is associated with the amount of penetrating ink T0 passing through the recording medium 6. It shows the amount of penetrating ink T0 for each type of the recording medium 6. When the controller 21 has identified the type of the recording medium 6, it specifies the amount of penetrating ink T0 corresponding to the type of the identified recording medium 6 from the data table 30.

The following describes the operation and function of the inkjet recording apparatus 1:

When the recording medium 6 is held over the distance from the master roller 8 to the take-up roller 9 and the drive roller 2 and take-up roller 9 have started rotation under this condition, the conveyance belt 5 is driven and the recording medium 6 is wound on the take-up roller 9 from the master roller 8, while being conveyed by the conveyance belt 5.

Under this condition, the recording head 7 emits ink by making a reciprocating motion on the front and rear of the sheet face given in FIG. 1. This ink reaches the recording medium 6 to form an image.

The ink that does not form an image—the ink, emitted from the recording head 7, having passed through the recording medium 6 (or the ink squeezed out of the lateral edge of the recording medium 6, when so-called "recording without border" has been made on the recording medium 6)—is deposited on the conveyance belt 5 and passes by the drive roller 2, with the rotation of the conveyance belt 5. Then it reaches the position of contact between the conveyance belt 5 and cleaning roller 10.

EXAMPLES

In the present embodiment, the operation of the cleaning roller 10 (selection between drive by the conveyance belt 5 and that by the motor 10*a*) is controlled in conformance to the following control modes 1 through 5 according to the instruction from the controller 21 of the computer 20.

The following describes the operation of the cleaning roller 10 for each of the control modes 1 through 5:

In the control modes 1 through 5, the cleaning roller specific gravity is set to 0.32 g/cm$^3$, the cleaning roller porosity 80%, the weight of the applied agglutinant 55.3 g/m$^2$, and the cleaning roller cross sectional length of contact 12 mm. The ink used in these control modes is water-based dispersion ink and the recording medium is polyester fabric.

[Control Mode 1]

In response to the result of detection of the rotary encoder 2*b*, the controller 15 of the inkjet recording apparatus 1 calculates the traveling speed V0 of the conveyance belt 5, and sends the result of calculation in the form of a signal to the controller 21 of the computer 20. Upon receipt of this signal, the controller 21 identifies the traveling speed V0 of the conveyance belt 5. Then a decision step is taken to determine if the traveling speed V0 satisfies V0<6 mm/second or V0≧6 mm/second. In the control mode 1, the amount of ink Q0 required to record an image on the recording medium 6 is set to 12 g/m$^2$.

If the controller 21 has determined as a result of the decision step that the traveling speed V0 satisfies V0<6 mm/second, a signal is sent to the controller 15 to indicate that the cleaning roller 10 is driven by the movement of the conveyance belt 5 (motor 10*a* is not driven). In this case, the controller 15 controls the motor 10*a* so that it is not operated. The cleaning roller 10 is driven by the rotation of the conveyance belt 5, and ink is removed at the position of contact.

In the meantime, when the controller 21 has determined that the traveling speed V0 satisfies V0≦6 mm/second, a signal is sent to the controller 15 to indicate that the cleaning roller 10 is driven independently of the movement of the conveyance belt 5 (motor 10*a* is driven). In this case, the controller 15 controls and operates the motor 10*a*. Without being driven by the rotation of the conveyance belt 5, the cleaning roller 10 is driven by the motor 10*a*, and the ink is removed at the position of contact with the conveyance belt 5 during this time.

Figure 6:
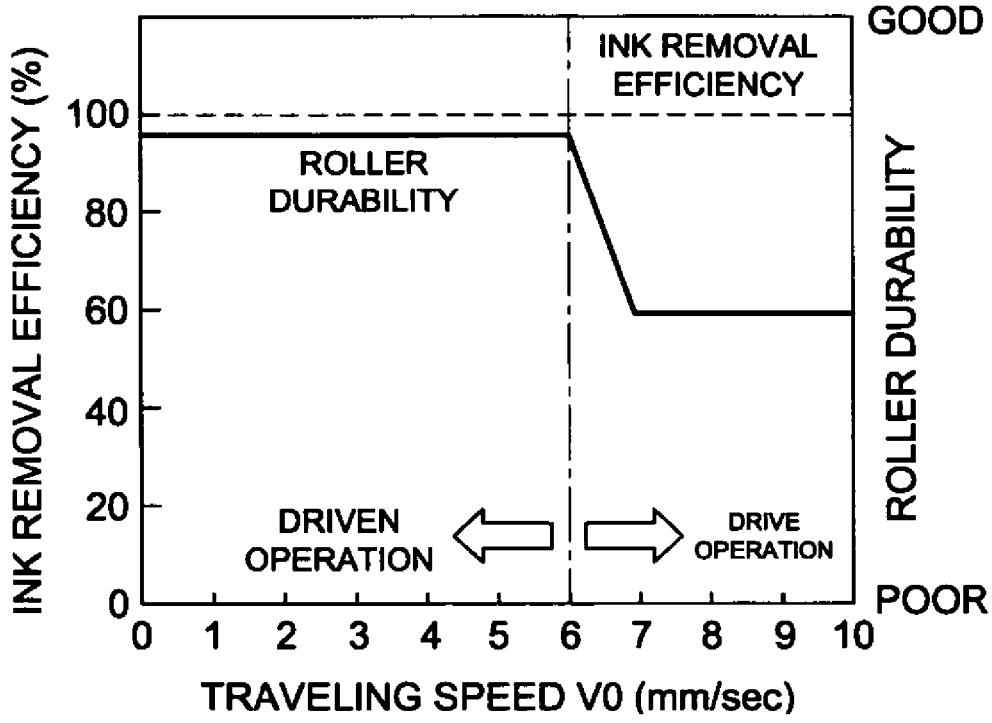
FIG. 6 is a diagram representing an example of the relationship between the "ink removal efficiency" and "cleaning roller durability" when the operation of the cleaning roller 10 is controlled in conformity to the traveling speed V0 of the conveyance belt 5.

In the control mode 1, the drive operation and driven operation of the cleaning roller 10 is switched according to the traveling speed V0 (=6 mm/second) of the conveyance belt. This is because, if the traveling speed V0 satisfies V0<6 mm/second, the roller durability of the cleaning roller 10 can be improved, while a high efficiency of removing ink from the conveyance belt 5 is maintained, as shown in FIG. 6. Conversely, if traveling speed V0 satisfies V0≧6 mm/second, a high efficiency of removing ink from the conveyance belt 5 is maintained, although durability of the cleaning roller 10 is slightly reduced.

[Control Mode 2]

In response to the result of detection of the photo-sensor 13, the controller 15 of the inkjet recording apparatus 1 calculates the width W0 of the recording medium 6, and sends the result of this calculation in the form of a signal to the controller 21 of the computer 20. Having received this signal, the controller 21 identifies the width W0 of the recording medium 6, and calculates the record width W1 from the image data of the image to be recorded on the recording medium 6. It then determines if the width W0 of the recording medium 6 with respect to the record width W1 (the width of the area reached by the ink within the area on the recording medium 6) satisfies W0>W1 or W0≦W1. In the control mode 2, the amount of ink Q0 required to record an image on the recording medium 6 is set at 12 g/m$^2$.

If the controller 21 has determined as a result of the decision step that the width W0 of the recording medium 6 satisfies W0>W1, a signal is sent to the controller 15 to indicate that the cleaning roller 10 is driven by the movement of the conveyance belt 5. In this case, the controller 15 controls the motor 10*a* so that it is not operated. The cleaning roller 10 is driven by the rotation of the conveyance belt 5, and ink is removed at the position of contact.

In the meantime, when the controller 21 has determined that the width W0 of the recording medium 6 satisfies W0≦W1, a signal is sent to the controller 15 to indicate that the cleaning roller 10 is driven independently of the movement of the conveyance belt 5 (causes the motor 10*a* to operate). In this case, the controller 15 controls and operates the motor 10*a*. Without being driven by the rotation of the conveyance belt 5, the cleaning roller 10 is driven by the motor 10*a*, and the ink is removed at the position of contact with the conveyance belt 5 during this time.

In the control mode 2, the drive operation and driven operation of the cleaning roller 10 is switched according to the width W0 of the recording medium 6. This is because, if the width W0 of the recording medium 6 satisfies W0>W1, the ink emitted from the recording head 7 only passes through the recording medium 6 to be deposited on the conveyance belt 5, without squeezing out of the edge of the recording medium 6 to directly adhere to the conveyance belt 5 (a smaller amount of ink deposited on the conveyance belt 5). This allows the cleaning roller 10 to be driven by the movement of the conveyance belt 5, and ensures a thorough removal of the ink deposited on the conveyance belt 5. Conversely, if the width W0 of the recording medium 6 satisfies W0≦W1, the ink emitted from the recording head 7 passes through the recording medium 6 to be deposited on the conveyance belt 5. Not only that, the ink will squeezes out of the edge of the recording medium 6 to directly adhere to the conveyance belt 5 (a greater amount of ink deposited on the conveyance belt 5). Thus, a thorough removal of the ink deposited on the conveyance belt 5 cannot be removed if the cleaning roller 10 is not driven.

[Control Mode 3]

The controller 21 acquires the type of the recording medium 6 from the image data of the image to be recorded on the recording medium 6, and specifies the amount of penetrating ink T0 corresponding to the recording medium 6 of that type from the data table 30. A decision step is taken to determine if the amount of penetrating ink T0 satisfies T0≦12 g/m$^2$ or T0>12 g/m$^2$. In the control mode 3, the traveling speed V0 of the conveyance belt 5 is set at 6 mm/second.

If the controller 21 has determined as a result of the decision step that the amount of penetrating ink T0 satisfies T0≦12 g/m$^2$, a signal is sent to the controller 15 to indicate that the cleaning roller 10 is driven by the movement of the conveyance belt 5. In this case, the controller 15 controls the motor 10*a* so that it is not operated. The cleaning roller 10 is driven by the rotation of the conveyance belt 5, and ink is removed at the position of contact.

In the meantime, when the controller 21 has determined that the amount of penetrating ink T0 satisfies T0>12 g/m$^2$, a signal is sent to the controller 15 to indicate that the cleaning roller 10 is driven independently of the movement of the conveyance belt 5 (causes the motor 10*a* to operate). In this case, the controller 15 controls and operates the motor 10*a*. Without being driven by the rotation of the conveyance belt 5, the cleaning roller 10 is driven by the motor 10*a*, and the ink is removed at the position of contact with the conveyance belt 5 during this time.

Figure 7:
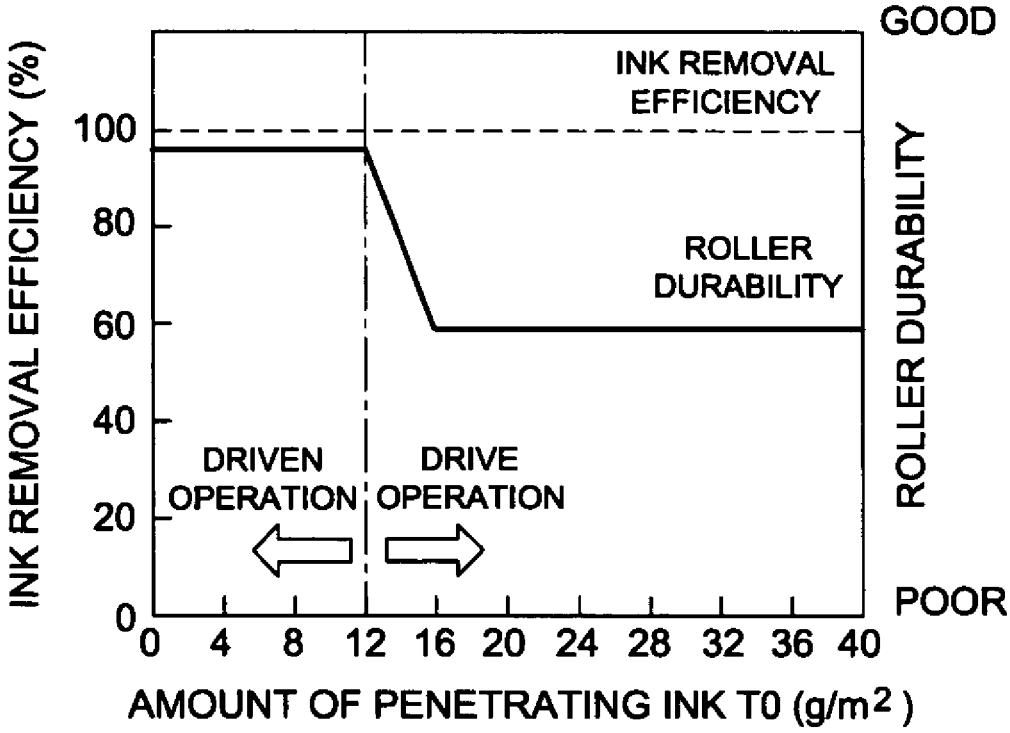
FIG. 7 is a diagram representing an example of the relationship between the "ink removal efficiency" and "cleaning roller durability" when the operation of the cleaning roller 10 is controlled in conformity to the amount of ink T0 having passed through the recording medium 6.

In the control mode 3, the drive operation and driven operation of the cleaning roller 10 is switched according to the amount of ink T0 (=12 g/m$^2$) passing through the recording medium 6. This is because, if the amount of ink T0 satisfies T0≦12 g/m$^2$, the roller durability of the cleaning roller 10 can be improved, while a high efficiency of removing ink from the conveyance belt 5 is maintained, as shown in FIG. 7. Conversely, if the amount of ink T0 satisfies T0>12 g/m$^2$, a high efficiency of removing ink from the conveyance belt 5 is maintained, although durability of the cleaning roller 10 is slightly reduced.

[Control Mode 4]

The controller 21 acquires the resolution and record size of an image from the image data of the image to be recorded on the recording medium 6 and calculates the amount of ink Q0 required to record the image on the recording medium 6. A decision step is taken to determine if the amount of ink Q0 satisfies Q0≦12 g/m$^2$ or Q0>12 g/m$^2$. In the control mode 4, the traveling speed V0 of the conveyance belt 5 is set at 6 mm/second.

If the controller 21 has determined as a result of the decision step that the amount of ink Q0 satisfies Q0≦12 g/m$^2$, a signal is sent to the controller 15 to indicate that the cleaning roller 10 is driven by the movement of the conveyance belt 5. In this case, the controller 15 controls the motor 10*a* so that it is not operated. The cleaning roller 10 is driven by the rotation of the conveyance belt 5, and ink is removed at the position of contact.

In the meantime, when the controller 21 has determined that the amount of ink Q0 satisfies Q0>12 g/m$^2$, a signal is sent to the controller 15 to indicate that the cleaning roller 10 is driven independently of the movement of the conveyance belt 5 (causes the motor 10*a* to operate). In this case, the controller 15 controls and operates the motor 10*a*. Without being driven by the rotation of the conveyance belt 5, the cleaning roller 10 is driven by the motor 10*a*, and the ink is removed at the position of contact with the conveyance belt 5 during this time.

Figure 8:
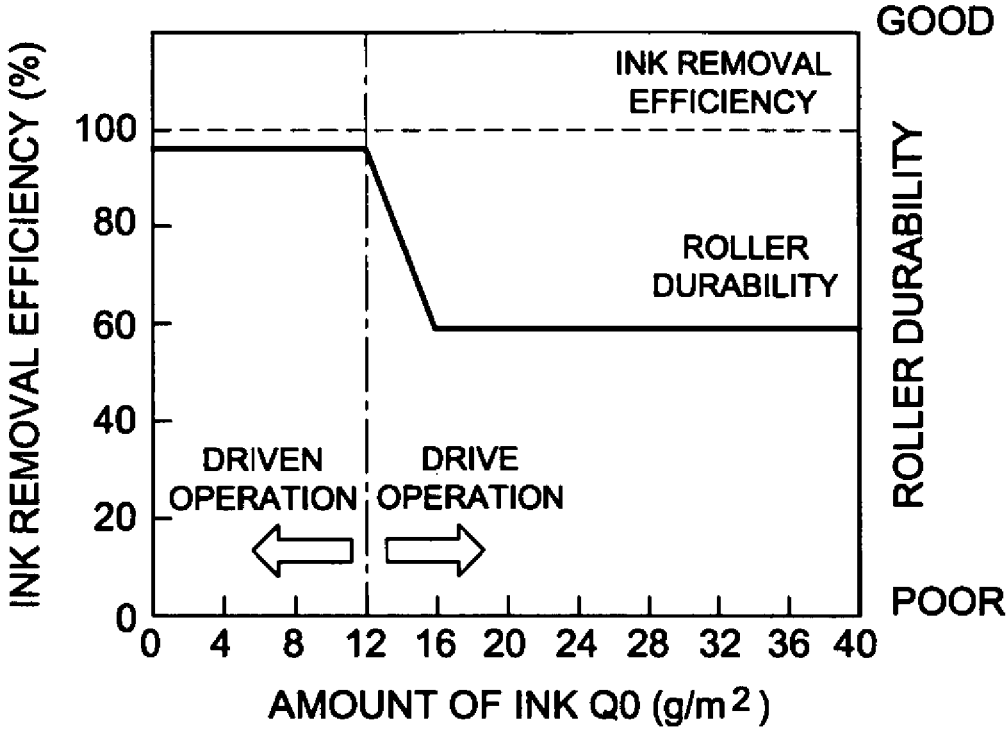
FIG. 8 is a diagram representing an example of the relationship between the "ink removal efficiency" and "cleaning roller durability" when the operation of the cleaning roller 10 is controlled in conformity to the amount of ink Q0 required to record an image.

In the control mode 4, the drive operation and driven operation of the cleaning roller 10 is switched according to the amount of ink Q0 (=12 g/m$^2$) required to record an image. This is because, if the amount of ink Q0 satisfies Q0≦12 g/m$^2$, the roller durability of the cleaning roller 10 can be improved, while a high efficiency of removing ink from the conveyance belt 5 is maintained, as shown in FIG. 8. Conversely, if the amount of ink Q0 satisfies Q0>12 g/m$^2$, a high efficiency of removing ink from the conveyance belt 5 is maintained, although durability of the cleaning roller 10 is slightly reduced.

[Control Mode 5]

The controller 21 calculates the amount of deposited ink H0 deposited on conveyance belt 5 from the image data of the image to be recorded on the recording medium 6, and takes a decision step to determine if the amount of deposited ink H0 satisfies H0≦30% or H0>30%. The amount of deposited ink in the sense in which it is used here can be defined as the percentage of the amount of ink directly deposited on the conveyance belt 5 by passing through the recording medium 6 or squeezing out of the edge of the recording medium 6. With respect to the amount of ink emitted from the recording head 7. In the control mode 5, for example, the amount of ink Q0 is set at 40 g/m$^2$; accordingly, if the H0=30% is satisfied, the amount of ink directly deposited on the conveyance belt 5 is 12 g/m$^2$. In the control mode 5, the traveling speed V0 of the conveyance belt 5 is set at 6 mm/second.

If the controller 21 has determined as a result of the decision step that the amount of deposited ink H0 satisfies H0≦30%, a signal is sent to the controller 15 to indicate that the cleaning roller 10 is driven by the movement of the conveyance belt 5. In this case, the controller 15 controls the motor 10*a* so that it is not operated. The cleaning roller 10 is driven by the rotation of the conveyance belt 5, and ink is removed at the position of contact.

In the meantime, when the controller 21 has determined that the amount of deposited ink H0 satisfies H0>30%, a signal is sent to the controller 15 to indicate that the cleaning roller 10 is driven independently of the movement of the conveyance belt 5 (causes the motor 10*a* to operate). In this case, the controller 15 controls and operates the motor 10*a*. Without being driven by the rotation of the conveyance belt 5, the cleaning roller 10 is driven by the motor 10*a*, and the ink is removed at the position of contact with the conveyance belt 5 during this time.

Figure 9:
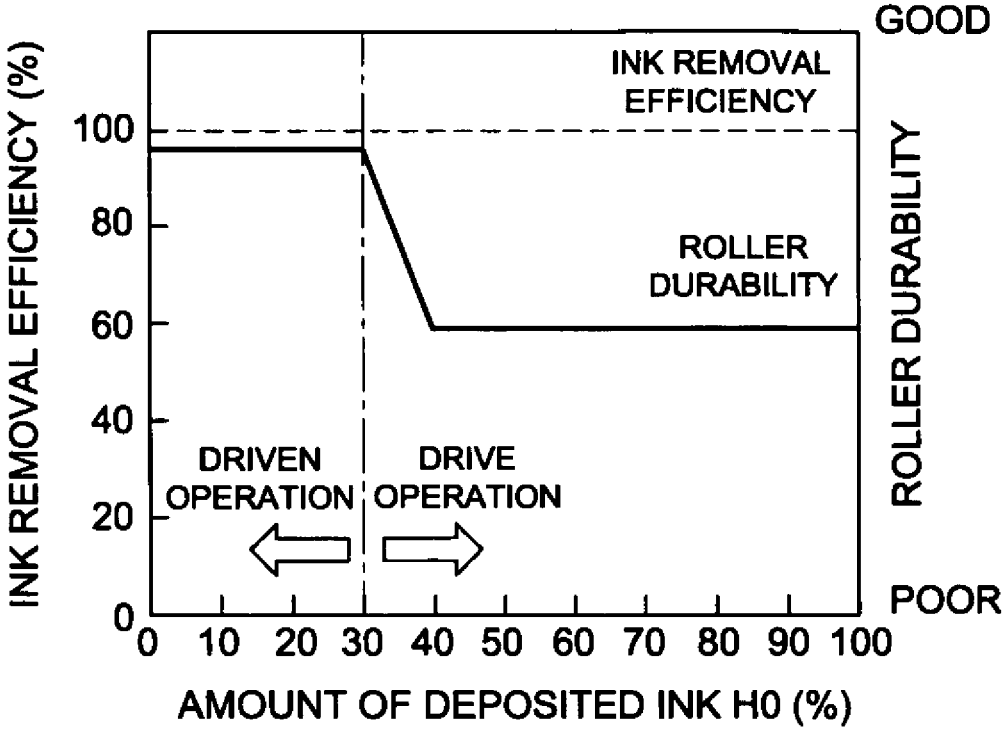
FIG. 9 is a diagram representing an example of the relationship between the "ink removal efficiency" and "cleaning roller durability" when the operation of the cleaning roller 10 is controlled in conformity to the amount of ink H0 deposited on the conveyance belt.
Figure 10:
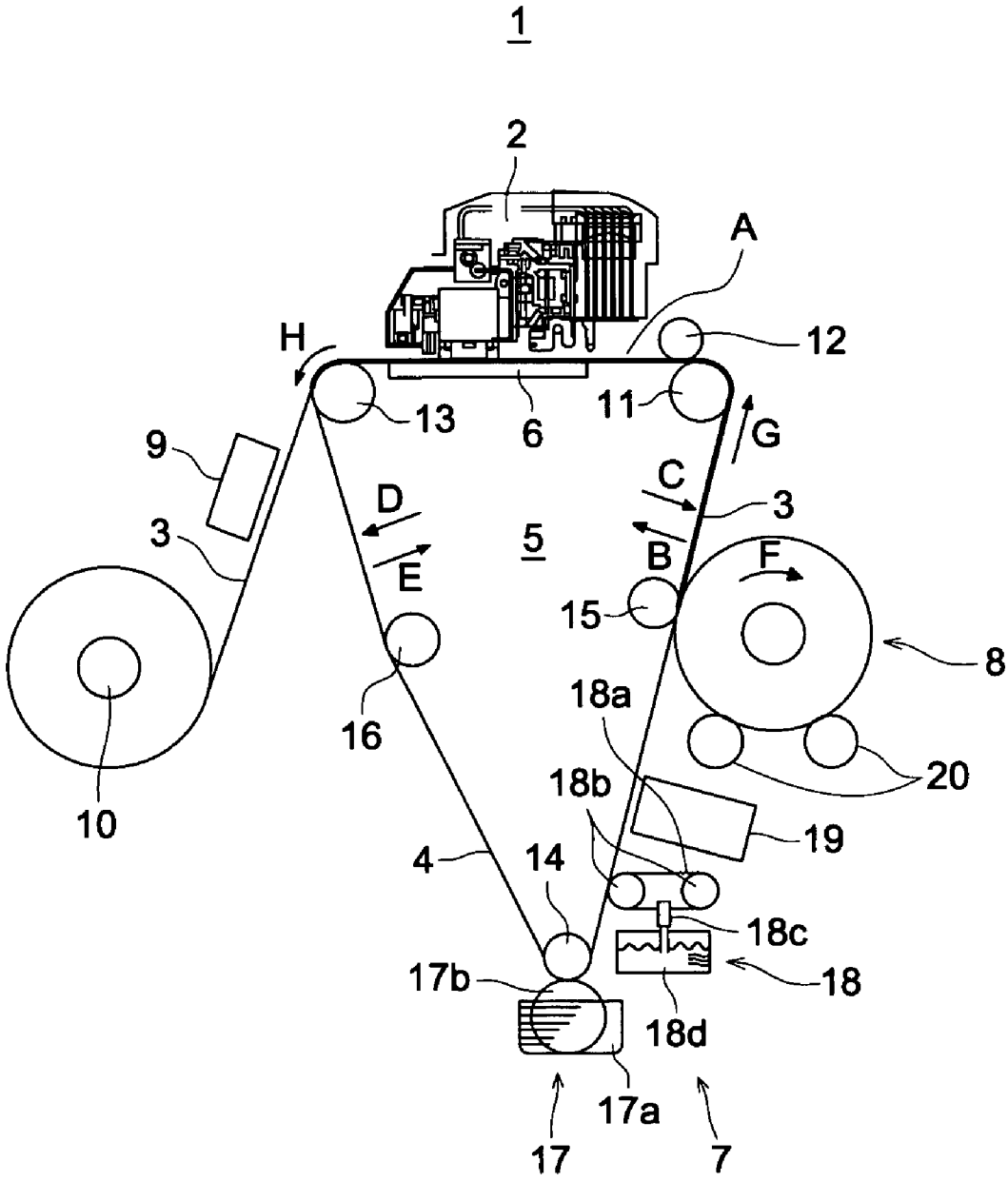
FIG. 10 is a diagram representing a technique disclosed in Patent Document 1.
Figure 11:
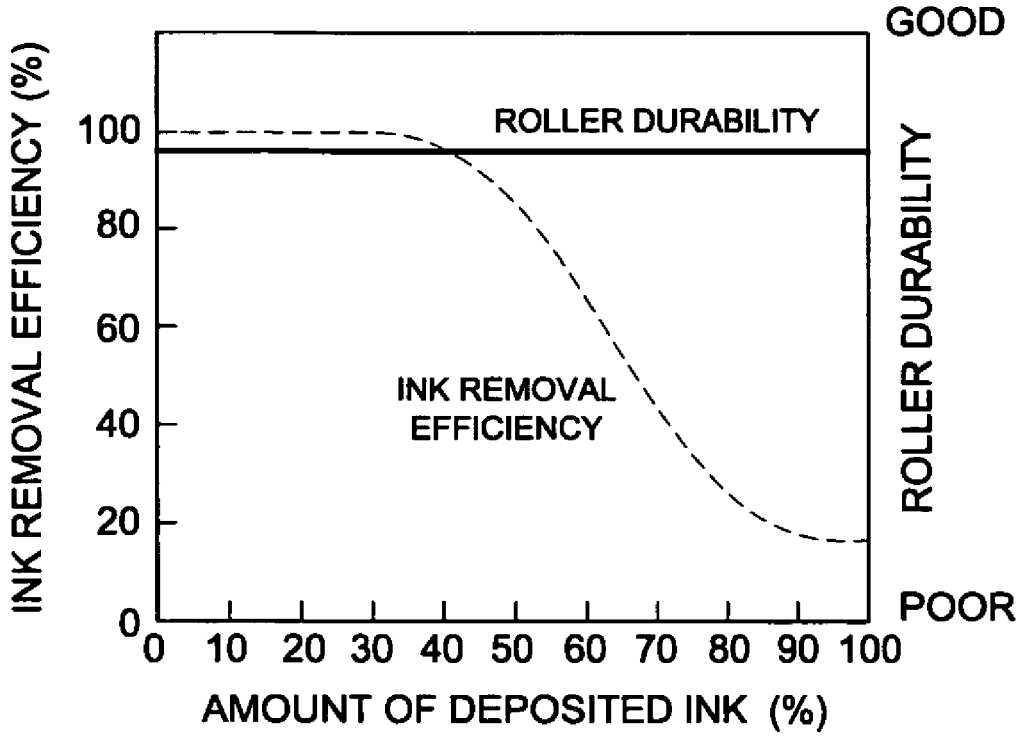
FIG. 11 is a diagram representing the relationship between the "ink removal efficiency" and "cleaning roller durability" when the operation of the cleaning roller 10 is controlled in conformity to the amount of ink deposited on the conveyance belt.
Figure 12:
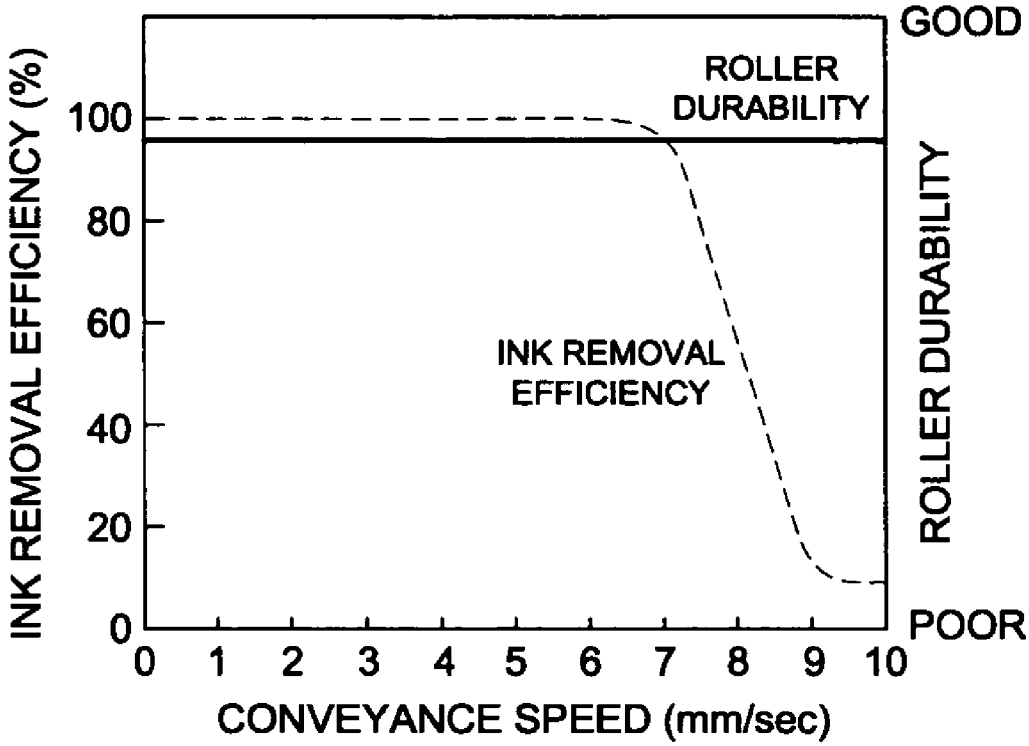
FIG. 12 is a diagram representing the relationship between the "ink removal efficiency" and "cleaning roller durability" when the operation of the cleaning roller 10 is controlled in conformity to the recording medium conveyance speed.
Figure 13:
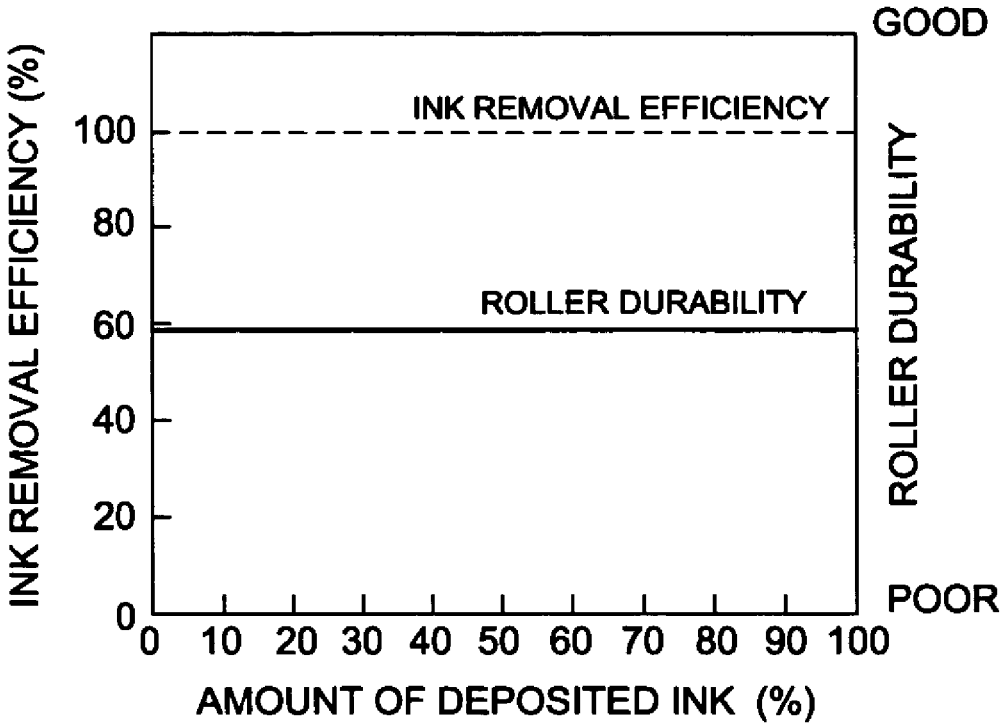
FIG. 13 is a diagram representing the relationship between the "ink removal efficiency" and "cleaning roller durability" when the cleaning roller 10 is driven.

In the control mode 5, the drive operation and driven operation of the cleaning roller 10 is switched according to the amount of ink H0 (=30%) deposited on conveyance belt 5. This is because, if the amount of deposited ink H0 satisfies H0≦30%, the roller durability of the cleaning roller 10 can be improved, while a high efficiency of removing ink from the conveyance belt 5 is maintained, as shown in FIG. 9. Conversely, if the amount of deposited ink H0 satisfies H0>30%, a high efficiency of removing ink from the conveyance belt 5 is maintained, although durability of the cleaning roller 10 is slightly reduced.

In the inkjet recording apparatus 1, the operations are repeated in the control modes 1 through 5, and an image is recorded on the recording medium 6. The conveyance belt 5 is washed by cleaning roller 10.

In the control modes 1 through 5, while the cleaning roller 10 is driven by the motor 10*a*, the outer peripheral linear speed R0 of the cleaning roller 10 can be changed as desired within the range from 20 through 120 mm/second according to the instruction of the controller 21 of the computer 20 through the controller 15 of the inkjet recording apparatus 1.

If the outer peripheral speed R0 is less than 20 mm/second, the cleaning roller area in contact with the ink deposited on the conveyance belt will be reduced in size, with the result that ink removal efficiency may deteriorate. If the outer peripheral speed R0 is over 120 mm/second, the efficiency of removing ink from the conveyance belt remains unchanged, and roller durability may be reduced by friction with conveyance belt.

The inkjet recording apparatus 1 uses the computer 20 to choose whether the cleaning roller 10 is driven by the movement of the conveyance belt 10 or by a motor independently of the movement of the conveyance belt 10.

Accordingly, if the traveling speed V0 of the conveyance belt 5, the width W0 of the recording medium 6, the amount of ink T0 passing through the recording medium 6, the amount of ink Q0 required to record an image and the amount of ink H0 deposited on conveyance belt 5 meet one of the conditions, the cleaning roller 10 can be driven by the conveyance belt 5. The roller durability of the cleaning roller 10 can be improved, while a high efficiency of removing ink from the conveyance belt 5 is maintained (FIGS. 6 through 9).

The traveling speed V0 of the conveyance belt 5, the width W0 of the recording medium 6, the amount of ink T0 passing through the recording medium 6, the amount of ink Q0 required to record an image and the amount of ink H0 deposited on conveyance belt 5 meet the other conditions, the cleaning roller 10 can be driven by a motor independently of the conveyance belt 5, and a high efficiency of removing ink from the conveyance belt 5 is maintained, although durability of the cleaning roller 10 is slightly reduced (FIGS. 6 through 9).

The arrangement ensures that, according to the traveling speed V0 of the conveyance belt 5, the width W0 of the recording medium 6, the amount of ink T0 passing through the recording medium 6, the amount of ink Q0 required to record an image and the amount of ink H0 deposited on conveyance belt 5 meet the other conditions, the roller durability of the cleaning roller 10 can be improved, while a high efficiency of removing ink from the conveyance belt 5 is maintained.

Without being restricted thereto, the present invention can be embodied in a great number of variations with appropriate improvement and design modification, without departing from the technological spirit and scope of the invention.

As an example of the improvement and design modification, the controller 15 of the inkjet recording apparatus 1 provided with the processing function of the controller 21 of the computer 20 may implement the processing in conformity to the control modes 1 through 5.

As another example of the improvement and design modification, the control mode used to switch between the drive/driven operations of the cleaning roller 10 may be:

any one of the control modes 1 through 5; a combination of any two of the control modes 1 through 5;

a combination of any three of the control modes 1 through 5;

a combination of any four of the control modes 1 though 5; or all of the control modes 1 through 5.

What is claimed is:

1. An inkjet recording apparatus comprising:

a conveyance belt for conveying a recording medium;

a cleaning roller kept in contact with the conveyance belt to clean the conveyance belt; and a controller for controlling the cleaning roller so as to be able to select between two modes for driving the cleaning roller, wherein the two modes comprise a mode in which the cleaning roller is driven by movement of the conveyance belt and a mode in which the cleaning roller is driven independently of the movement of the conveyance belt.

2. The inkjet recording apparatus of claim 1, wherein controller comprises a computer which conducts the controlling by instruction from the computer.

3. An inkjet recording apparatus comprising:

a conveyance belt for conveying a recording medium;

a cleaning roller kept in contact with the conveyance belt to clean the conveyance belt; and a controller for controlling the cleaning roller so as to be able to select between two modes for driving the cleaning roller, wherein the two modes comprise a mode in which the cleaning roller is driven by movement of the conveyance belt and a mode in which the cleaning roller is driven independently of the movement of the conveyance belt, wherein controller comprises a computer which conducts the controlling by instruction from the computer, and wherein the computer (i) has a data table that indicates an amount of penetrating ink T0 that passes through the recording medium, for each type of the recording medium, (ii) specifies, based on the data table, the amount of penetrating ink T0 of the recording medium on which an image is recorded, and (iii) controls the cleaning roller to be driven by the movement of the conveyance belt when the computer determines that the amount of penetrating ink T0 is not more than 12 $mg/m^2$.

4. An inkjet recording apparatus comprising:

a conveyance belt for conveying a recording medium;

a cleaning roller kept in contact with the conveyance belt to clean the conveyance belt; and a controller for controlling the cleaning roller so as to be able to select between two modes for driving the cleaning roller, wherein the two modes comprise a mode in which the cleaning roller is driven by movement of the conveyance belt and a mode in which the cleaning roller is driven independently of the movement of the conveyance belt, wherein controller comprises a computer which conducts the controlling by instruction from the computer, and wherein the computer (i) has a data table that indicates an amount of penetrating ink T0 that passes through the recording medium, for each type of the recording medium, (ii) specifies, based on the data table, the amount of penetrating ink T0 of the recording medium on which an image is recorded, and (iii) controls the cleaning roller to be driven independently of the movement of the conveyance belt when the computer determines that the amount of penetrating ink T0 is more than 12 $mg/m^2$.

5. The inkjet recording apparatus of claim 1, wherein the cleaning roller is an elastic member made of a porous material.

6. The inkjet recording apparatus of claim 3, wherein the cleaning roller is an elastic member made of a porous material.

7. The inkjet recording apparatus of claim 6, wherein a specific gravity of the cleaning roller is 0.32 to 0.34 $g/cm^3$.

8. The inkjet recording apparatus of claim 6, wherein porosity of the cleaning roller is 75 to 90%.

9. The inkjet recording apparatus of claim 4, wherein the cleaning roller is an elastic member made of a porous material.

10. The inkjet recording apparatus of claim 9, wherein a specific gravity of the cleaning roller is 0.32 to 0.34 $g/cm^3$.

11. The inkjet recording apparatus of claim 9, wherein porosity of the cleaning roller is 75 to 90%.

* * * * *